US006414256B1

(12) United States Patent
Chen et al.

(10) Patent No.: US 6,414,256 B1
(45) Date of Patent: Jul. 2, 2002

(54) CURRENT LIMITING CIRCUIT BREAKER

(75) Inventors: William Weizhong Chen, Marion; Frank Ehrenberger, North Liberty; Aaron Bottorff, Central City; Matt Sortland, Swisher, all of IA (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/745,019

(22) Filed: Dec. 20, 2000

(51) Int. Cl.[7] ..... H01H 9/32

(52) U.S. Cl. ..... 218/89; 218/117; 335/201; 335/16

(58) Field of Search ..... 218/89, 117, 22; 335/201, 202, 16, 147, 195

(56) References Cited

U.S. PATENT DOCUMENTS 4,562,323 A * 12/1985 Belbel et al. ..... 218/117
4,801,772 A * 1/1989 Bratkowski et al. ..... 218/117

FOREIGN PATENT DOCUMENTS

WO WO99/10903 * 3/1999

* cited by examiner

*Primary Examiner*—Lincoln Donovan
(74) *Attorney, Agent, or Firm*—Kareem M. Irfan; Larry I. Golden

(57) ABSTRACT

The present invention provides a current limiting circuit breaker having a current responsive device for opening a pair of contacts or switch upon short circuit conditions. The current responsive device utilizes an insulating object driven by a magnetic force caused by a short circuit current. Upon opening of the contacts with the use of the insulating object, let-through current flows through a secondary contact, positioned on the insulating object, to a positive temperature coefficient resistivity element which limits the current and arcing in the contacts. The PTC elements could be pure metallic materials such as pure tungsten, pure iron, etc. Conductive polymer and ceramic PTC materials could also be used for some specific applications. The present invention also provides a method of electrically connecting a drive plate and a line terminal on the current limiting circuit breaker.

16 Claims, 4 Drawing Sheets

CURRENT LIMITING CIRCUIT BREAKER

CROSS REFERENCE TO RELATED APPLICATION

This application takes priority from copending U.S. patent application Ser. No. 09/584,226, filed on May 31, 2000.

FIELD OF THE INVENTION

This invention relates to the use of current liming elements and positive temperature coefficient resistivity (PTC) elements in circuit breakers to limit the arcing and interruption pressure that results from the operation of a circuit breaker under short circuit conditions.

BACKGROUND OF THE INVENTION

Circuit breakers are widely used in residential and industrial applications for the interruption of electrical current in power lines upon conditions of severe overcurrent caused by short circuits or ground faults. One of the problems associated with the process of interruption of current during severe overcurrent conditions is arcing. Arcing occurs between the contacts of circuit breakers used to interrupt the current and is highly undesirable for several reasons. Arcing causes deterioration of the circuit breaker contacts and produces gas pressure within the circuit breaker. Arcing also necessitates circuit breakers have a larger separation between the contacts in the open position to extinguish the arc during high current faults. Prior art devices have used a number of approaches to limit the occurrence of arcing. For example, in heavy duty switchgear, the circuit breaker contacts may be enclosed in a vacuum or in an atmosphere of $SF_6$. Both of these approaches are expensive.

Another approach to limit the amount of arcing is the use of a resistor connected in parallel with the contacts of the circuit breaker. Upon opening of the contacts, current can flow through the shunt resistor, effectively reducing the amount of arcing in the contacts. The current flowing through the resistor is less than the short circuit current that would flow through the contacts in the absence of the resistor.

A current limiting circuit breaker or current limiter typically can provide limitation to the let-through current during a short circuit. The current limiter can interrupt a short circuit before the available current reaches zero. In other words, the current limiter can dramatically reduce both the peak current ($I_p$) and the let-through energy ($I^2t$) values compared to conventional circuit breakers. In conventional current limiting breakers, almost 100% of the interruption energy goes to generate arc and pressure upon a short circuit. The interruption pressure sometimes is too high to keep the breaker and the end-use equipment intact without using heavy-duty designs for them. In an attempt to address this problem and to achieve the above current limitation functions, costly components are being added to conventional circuit breakers.

The present invention provides for a cost efficient manner to increase current limitation effectiveness and decrease the interruption pressure within the circuit breaker, thereby improving the interruption rating of the circuit breaker and greatly reducing the potential damage to end-use equipment. Therefore, this invention allows for the design of better performing and less expensive current limiters than conventional current limiting circuit breakers.

SUMMARY OF THE INVENTION

The present invention provides a current limiting circuit breaker having a current responsive device for opening a pair of contacts or switch upon short circuit conditions. The current responsive device utilizes an insulating object driven by a magnetic force caused by a short circuit current. Upon opening of the contacts with the use of the insulating object, let-through current flows through a secondary contact, positioned on the insulating object, to a positive temperature coefficient resistivity element which limits the current and arcing in the contacts. The PTC elements could be pure metallic materials such as pure tungsten, pure iron, etc. Conductive polymer and ceramic PTC materials could also be used for some specific applications.

The present invention also provides a method of electrically connecting a drive plate and a line terminal on the current limiting circuit breaker.

Examples of the more important features of the invention have been summarized rather broadly in order that the detailed description thereof that follows may be better understood, and in order that the contributions to the art may be appreciated. There are additional features of the invention that will be described hereinafter and which will form the subject of the claims appended hereto.

BRIEF DESCRIPTION OF THE FIGURES

For a detailed understanding of the present invention, references should be made to the following detailed description of the preferred embodiment, taken in conjunction with the accompanying drawings, in which like elements have been given similar numerals, and wherein.

DETAILED DESCRIPTION OF THE INVENTION

Figure 1:
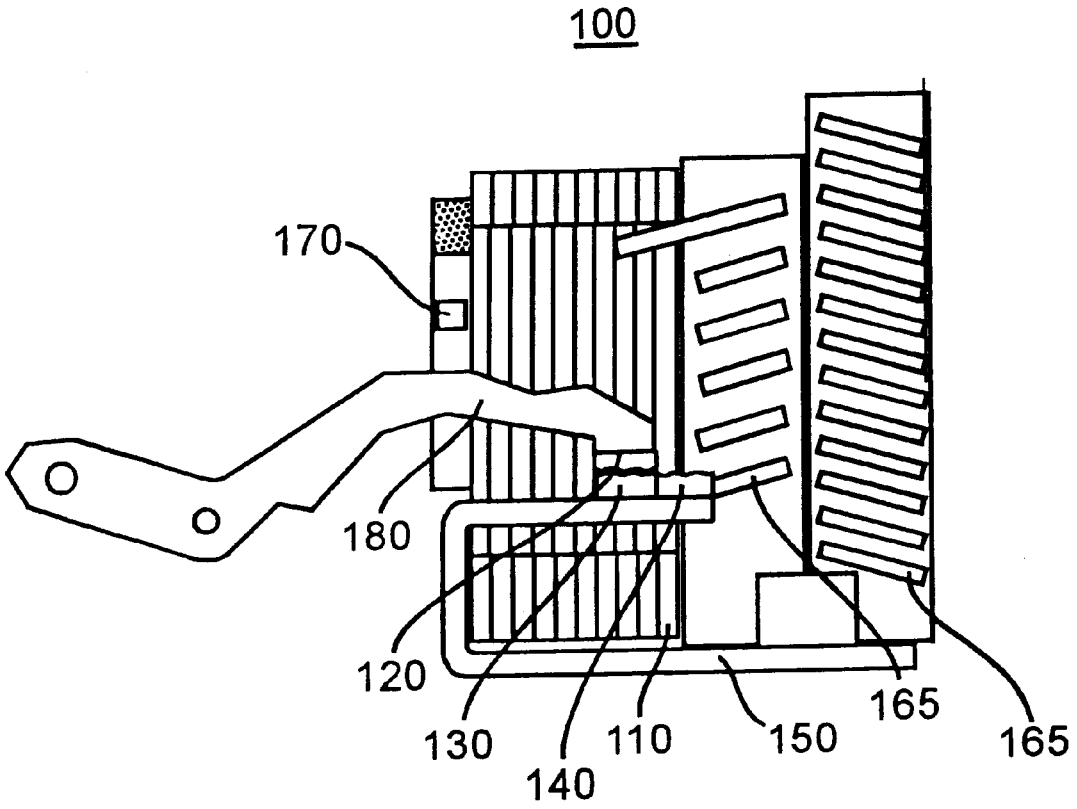
PRIOR ART Fig. 1
FIG. 1 illustrates a prior art current limiting circuit breaker.

FIG. 1 illustrates a prior art circuit breaker 100 wherein an "O" magnet 110 is placed around a movable contact 120 and a stationary contact 130. An arcing contact 140 is placed side by side with the stationary contact 130. Both the stationary contact 130 and the arcing contact 140 are welded on a line terminal 150. An assembly of arc stack 160 and an assembly of baffle stack 165 are used in the arc chute (not shown). A catcher 170 is placed across a blade 180 and at the back side of the "O" magnet 110. A magnetic tripping mechanism (not shown) of the circuit breaker 100 is responsive to current flow and is adapted to move the moveable contact 120.

Under normal operation, current flows from the line terminal 150, through the stationary contact 130 and movable contact 120 and then through the blade 180. When a short circuit occurs, the "O" magnet 110 increases the blowing off force of the blade 180 and stretches any generated arc into the arc stack 160. The catcher 170 catches the blade 180 and keeps it in an open state after the blade 180 is wide open. The current is finally interrupted when the arc is cooled down and extinguished in the arc chute. The magnetic tripping mechanism releases the spring energy that instantaneously opens the circuit breaker 100 when the current is higher than a predetermined value, such as 10 times the current rating of the circuit breaker 100.

Figure 2:
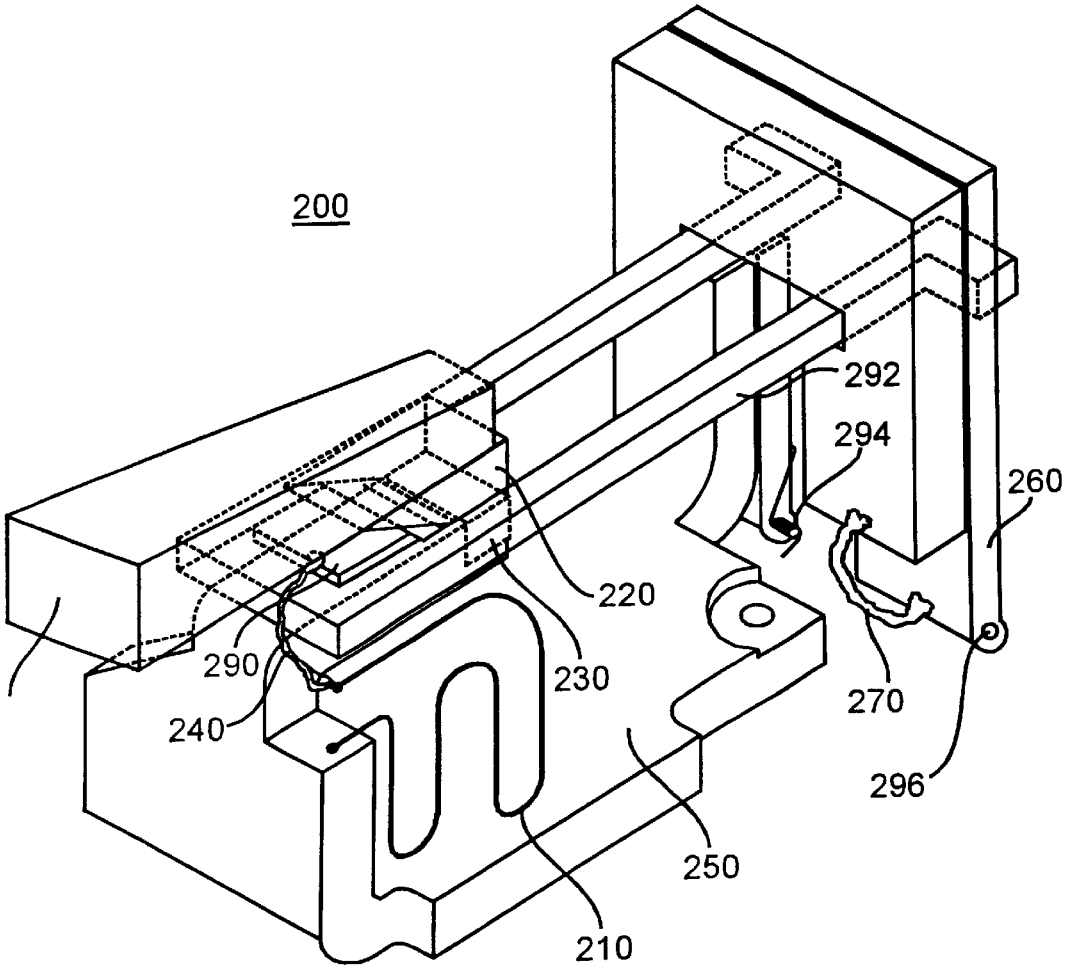
FIG. 2 illustrates a preferred embodiment of the present invention wherein a current responsive device generates a magnetic repulsive force to insert an insulating object between a pair of contacts thereby providing an electrical connection to a positive temperature coefficient resistivity element, which limits current and absorbs energy in a short circuit.

The circuit breaker in FIG. 2 illustrates the present invention, a circuit breaker 200 comprising a component 210, preferably made from tungsten, connected at one end to the line terminal 250, which is fixedly connected to the circuit breaker 200, and to a flexible connector 240 at the other end. The serpentine shape of the component 210 is designed to reduce self-inductance. A movable driving plate 260 is placed at the end of the line terminal 250. An additional flexible connector 270 is used to electrically connect the driving plate 260 and the line terminal 250. As discussed below, there are multiple ways to connect the flexible connector 270 to the driving plate 260. The circuit breaker 200 contains three individual contacts: a stationary contact 230, connected to the line terminal 250, a movable contact 220, connected to a blade 280 and a secondary contact 290, which is preferably wedge shaped, mounted on an insulating object 292. The insulating object 292 is preferably made from thermoset materials that have a good dielectric strength and also a strong arc resistance capacity. An air gap exists between the movable contact 220 and the secondary contact 290. The flexible connector 240 electrically connects the secondary contact 290 on the insulating object 292 to component 210. The insulating object 292 has two legs to allow the driving plate 260 to move the insulating object 292 and the secondary contact 290 whenever there is an electrically generated magnetic repulsive force between the driving plate 260 and line terminal 250. A torsion spring 294 is placed at the pivot axis 296 of the driving plate 260, to provide an opposing force relative to the magnetic repulsive force on the driving plate 260.

Figure 3:
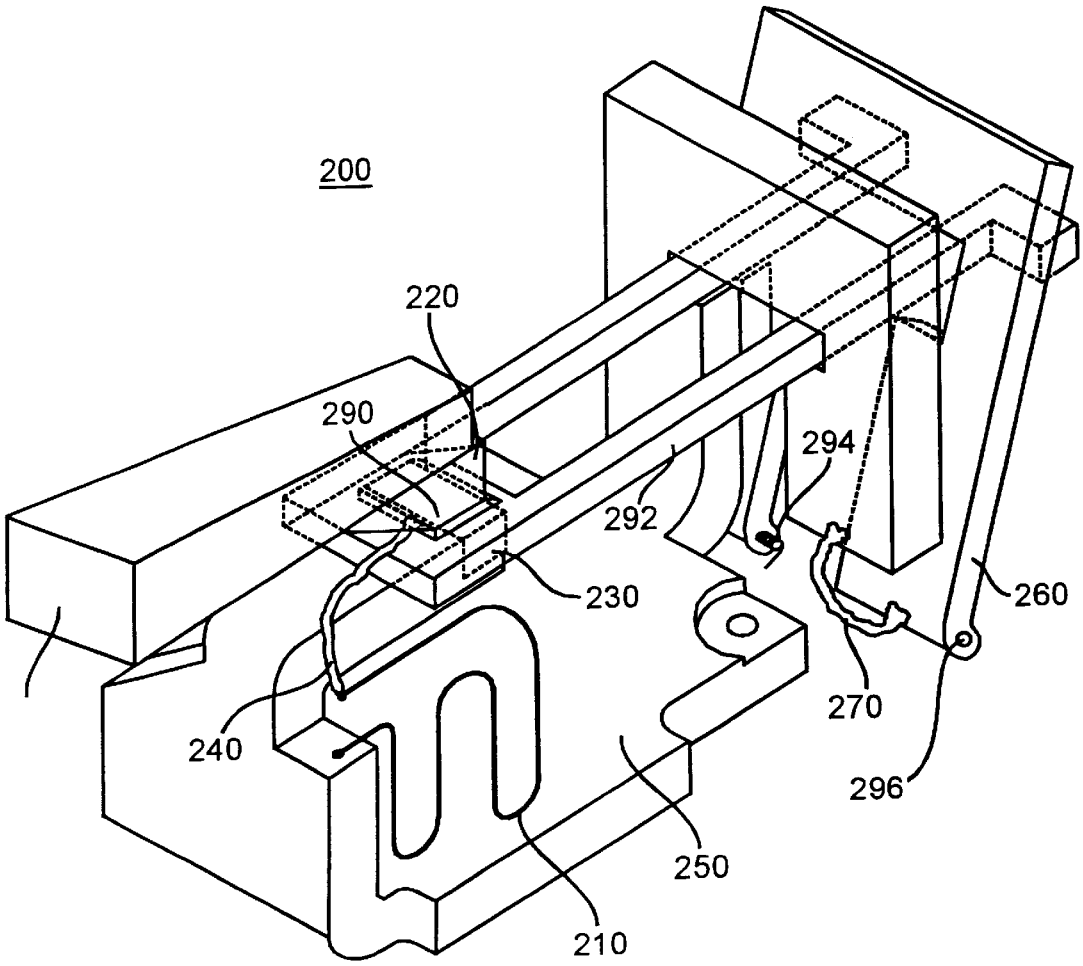
FIG. 3 illustrates the preferred embodiment of the present invention following a short circuit condition wherein a pair of contacts are separated.

Under normal operations, current flows in from the driving plate 260. Via flexible connector 270, current continues on to the line terminal 250. The current passes line terminal 250 to the stationary contact 230 and then to the movable contact 220 and blade 280. From the blade 280, current flows out of the breaker to the load. Since there is an air gap between the movable contact 220 and the secondary contact 290, no current flows to component 210 during normal operations and minimal overload situations. Current flows in the line terminal 250 and driving plate 260 provides a reverse loop of current. A constant repulsive force exists between the driving plate 260 and the line terminal 250 as long as there is current flow in both elements. The repulsive force is directionally proportional to the square of current. Under normal operations and small overload situations, the current is relatively small and the magnetic repulsive force is insignificant. In such situations, the magnetic repulsive force fails to overcome the force of the torsion spring 294 and there is no movement of the insulating object 292. When the current increases over approximately 10 times the circuit breaker current rating, the repulsive force is large enough to overcome the force of the torsion spring 294 and rotates the driving plate 260 around the pivot axis 296 thereby moving the insulating object 292. Under short circuit conditions, the large let-through current can generate a very large magnetic repulsive force on the driving plate 260. The driving plate 260 pulls the insulating object 292 and the secondary contact 290 very quickly. The secondary contact 290 chops at the movable contact 220 and causes the separation between the movable contact 220 and the stationary contact 230. As the insulating object 292 moves, the taper at the opening should physically shear or cut the arc between the moveable contact 220 and the stationary contact 230, as shown in FIG. 3. The arc between the moveable contact 220 and the stationary contact 230 is thus extinguished very quickly. The let-through current then flows through the secondary contact 290 to the component 210, which is heated. As a result of the positive temperature coefficient resistivity effect, during a short circuit, the resistance of the component 210 is capable of increasing approximately 15 times its room temperature value. The resistance added by component 210 limits the let-through current and absorbs a significant amount of the interruption energy created by the short circuit. The magnetic tripping mechanism (not shown) subsequently opens the moveable contact 220 and interrupts the short circuit. The torsion spring 294 will reset the driving plate 260 as soon as the current is interrupted and the breaker will be ready for the next short circuit condition.

The driving plate 260 is preferably made from aluminum since it is light in mass and a good conductor. The flexible connector 270 is preferably made from copper. Spot welding of the flexible connector 270 to the driving plate 260 is a common form of attachment. However, spot welding of a copper element to an aluminum element is quite difficult. Therefore, three methods may be used to attach the flexible copper connector 260 to the aluminum driving plate 270.

Figure 4:
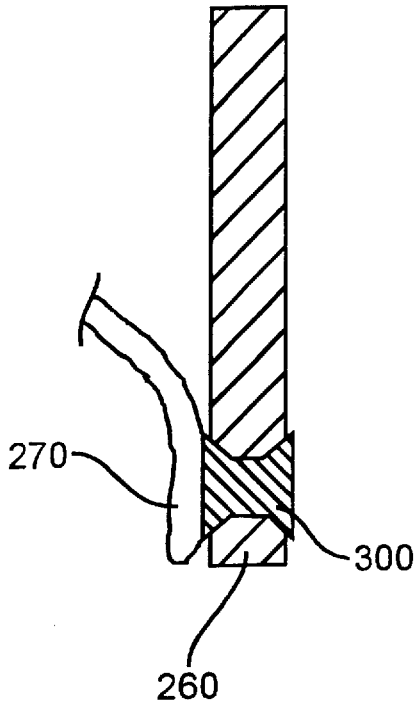
FIG. 4 illustrates a method of attaching a flexible connector to a driving plate for establishing an electrical connection between the driving plate and a line terminal.

FIG. 4 illustrates a method of attachment. A hole is made in the driving plate 270 and additional material is removed from the driving plate 270 on both sides, thus creating a bottleneck in the middle of the hole. A cylinder 300, preferably having the same metallic composition (i.e., copper) as the flexible connector 260, is then pressed into the hole so that the cylinder 300 will be formed into a rivet shape. The flexible connector 260 is mechanically fused to the cylinder 300. Fusing of the flexible connector 260 to the cylinder 300 may be accomplished by welding, brazing, bonding or soldering of the two elements.

Figure 5:
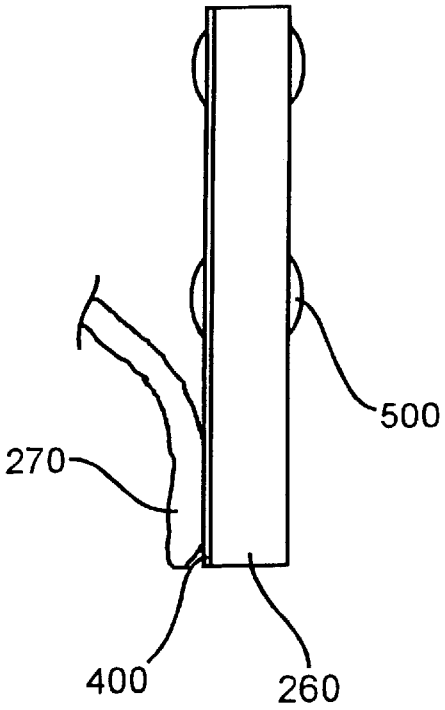
FIG. 5 illustrates an alternative method of attaching the flexible connector to the driving plate.

FIG. 5 illustrates an alternative method for the attachment of the flexible connector 260 and driving plate 270. A plate 400, having a similar metallic composition as the flexible connector 260, is mechanically attached to the driving plate 270 with the use of a plurality of rivets 500. The flexible connector 260 is then mechanically fused to the plate 400 thereby providing an electrical connection between the flexible connector 260 and the driving plate 270. Fusing of the flexible connector 260 to the plate 400 may be accomplished by welding, brazing, bonding or soldering of the two elements.

Another alternative method for the attachment of the flexible connector 260 and driving plate 270 involves plating the driving plate 270 with a metallic coating, such as copper or nickel. The flexible connector 260 is mechanically fused to the driving plate 270 after the plating is completed. Fusing of the flexible connector 260 to the driving plate 270 may be accomplished by welding, brazing, bonding or soldering of the two elements.

Several embodiments of the invention have been described. Various modifications and substitutions may be made thereto without departing from the spirit and scope of the invention. Accordingly, it is to be understood that the present invention has been described by way of illustrations and not by limitations.

We claim:

1. A circuit breaker for limiting the flow of electrical current in a line, comprising:

(a) a switch having a pair of contacts moveable with respect to each other defining an open position and a closed position;

(b) a device responsive to current in the line adapted to insert an insulating object between said pair of contacts; and (c) a positive temperature coefficient resistivity element electrically connected to said device to limit current and absorb energy when said insulating object is inserted between said pair of contacts and wherein said positive temperature coefficient resistivity element is electrically disconnected from said device when said insulating object is not inserted between said pair of contacts.

2. The circuit breaker of claim 1 wherein said device comprises:

(a) a line terminal fixedly connected to the circuit breaker; and (b) a moveable driving plate electrically connected to said line terminal for generation of a magnetic repulsive force upon application of the electrical current in said line terminal and said moveable driving plate.

3. The circuit breaker of claim 1 wherein said positive temperature coefficient resistivity element is electrically connected to said device through a secondary contact mounted on said insulating object.

4. The circuit breaker of claim 1 wherein said positive temperature coefficient resistivity element is made of tungsten.

5. The circuit breaker of claim 1 wherein said positive temperature coefficient resistivity element is made of iron.

6. The circuit breaker of claim 1 wherein said positive temperature coefficient resistivity element is made of a conductive polymer.

7. The circuit breaker of claim 1 wherein said positive temperature coefficient resistivity element is made of a conductive ceramic.

8. The circuit breaker of claim 1 wherein said positive temperature coefficient resistivity element has a substantially serpentine shape to reduce self-inductance.

9. The circuit breaker of claim 1 wherein said insulating object is made from a thermoset material for providing arc resistance.

10. The circuit breaker of claim 2 further comprising a spring adjacent said moveable driving plate for providing an opposing force relative to the magnetic repulsive force on said moveable driving plate.

11. The circuit breaker of claim 3 wherein said secondary contact is wedged shaped.

12. The circuit breaker of claim 3 wherein said insulating object has a plurality of legs to allow a moveable driving plate to move said insulating object and said secondary contact whenever there is an electrically generated magnetic repulsive force between said driving plate and a line terminal.

13. A circuit breaker for limiting the flow of electrical current in a line, comprising:

(a) a switch having a pair of contacts moveable with respect to each other defining an open position and a closed position;

(b) a device responsive to current in the line adapted to insert an insulating object between said pair of contacts; and (c) a positive temperature coefficient resistivity element electrically connected to said device to limit current, wherein said positive temperature coefficient resistivity element is electrically connected to said device through a secondary contact mounted on said insulating object.

14. The circuit breaker of claim 13 wherein said device comprises:

(a) a line terminal fixedly connected to the circuit breaker; and (b) a moveable driving plate electrically connected to said line terminal for generation of a magnetic repulsive force upon application of the electrical current in said line terminal and said moveable driving plate.

15. The circuit breaker of claim 13 wherein said secondary contact is wedged shaped.

16. The circuit breaker of claim 14 wherein said insulating object has a plurality of legs to allow said moveable driving plate to move said insulating object and said secondary contact whenever there is an electrically generated magnetic repulsive force between said driving plate and said line terminal.

* * * * *